US006394383B1

(12) United States Patent
Cope et al.

(10) Patent No.: US 6,394,383 B1
(45) Date of Patent: May 28, 2002

(54) WINDER FOR ELASTOMERIC FIBERS

(75) Inventors: Steven Andrew Cope, Newark; Joseph Edward Koskol, Wilmington, both of DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/717,424

(22) Filed: Nov. 21, 2000

(51) Int. Cl.[7] ..... B65H 54/22; B65H 67/48; B65H 54/28; B65H 54/42

(52) U.S. Cl. ..... 242/474.6; 242/486.1; 242/486.4; 242/477; 242/476.9

(58) Field of Search ..... 242/486.1, 486.4, 242/474.6, 477, 476.9

(56) References Cited

U.S. PATENT DOCUMENTS

| | | | |
|---|---|---|---|
| 3,165,274 | A | 1/1965 | De Preist |
| 3,675,863 | A | 7/1972 | Akers et al. |
| 3,861,607 | A | 1/1975 | Schippers et al. |
| 4,052,019 | A | 10/1977 | Dickson, Jr. |

FOREIGN PATENT DOCUMENTS

| | | |
|---|---|---|
| EP | EP0927694 | 7/1999 |
| JP | 2628969 | 7/1997 |
| WO | WO99/18024 | 4/1999 |

*Primary Examiner*—Donald P. Walsh
*Assistant Examiner*—Jonathan R Miller

(57) ABSTRACT

A winder for elastomeric fibers, which can reciprocate the fiber during winding and provides a substantially constant distance of fiber travel between the point where the fiber leaves the puller roll and the point where the fiber first contacts the contact roll, is provided.

10 Claims, 10 Drawing Sheets

WINDER FOR ELASTOMERIC FIBERS

BACKGROUND OF THE INVENTION

1. Field of the Invention

The present invention relates to a winder for winding of elastomeric fibers into packages and, more specifically, to a winder of particular geometries in which the fiber passes through a substantially constant distance between two rolls before it is wound onto the package.

2. Background Art

U.S. Pat. No. 3,165,274 and World Patent Application WO99/18024 disclose winders for elastomeric fibers, but winding such fibers at high speeds with such winders can result in high package relaxation.

U.S. Pat. No. 4,052,019 discloses an apparatus for back-winding an elastomeric fiber from a previously wound package onto a spool, but such an apparatus is not suited for high-speed, traversed winding of packages.

Japanese Patent JP02-628969-B2 discloses a winder having a withdrawal roller and a drive roller, in which fiber relaxation occurs on the package during winding. After the withdrawal roller, the fibers are passed through a twill braiding machine and then wound onto a bobbin by over-feeding to the bobbin, using a drive roller, at a speed more than 1.1 times the winding speed. The withdrawal roller speed is greater than or equal to the winding speed. The geometry of this winder is such that as the wound fiber package grows, the length of the filament between the withdrawal roller and the package decreases, resulting in an increasing laydown width and helix angle during winding and, in turn, poor package shape. Further, to prevent the growing package from touching the withdrawal roller, the length of filament between the withdrawal roller and the package must initially be large, making retention of a useful traverse pattern very difficult, a deficiency also created by the large distance of the traverse from the withdrawal roller. Similar considerations make the winder disclosed in U.S. Pat. No. 3,861,607, which requires extremely precise coordination of two traverse devices, and the complex winder of European Patent Application EP0927694 unsatisfactory.

Improved winders for elastomeric fibers are still needed.

SUMMARY OF THE INVENTION

The winder of the present invention for winding at least one elastomeric fiber at the exit of a spinning apparatus comprises:

(A) a traverse means for reciprocating the fiber;

(B) a driven puller roll for receiving the reciprocating fiber from the traverse means;

(C) a contact roll for receiving the fibers from the puller roll, the contact roll having a wrap angle of about 45–210°; wherein there is a substantially constant free fiber length between the puller roll and the contact roll for fiber passage; and (D) at least one chuck assembly for mounting a tubecore in contact with the contact roll.

DETAILED DESCRIPTION OF THE INVENTION

Figure 1D:
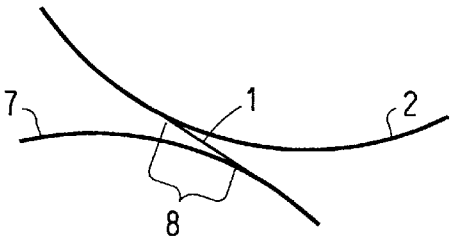
FIG. 1D shows a detail of FIG. 1A.

By "elastomeric fiber" is meant a filament which has a break elongation in excess of 100% independent of any crimp and which when stretched and released, retracts quickly and forcibly to substantially its original length. Such fibers include rubber fiber, spandex, polyetherester fiber, and elastoester. By "free fiber length" is meant the distance the fiber travels between the point at which it loses contact with the surface of the puller roll and the point at which it first makes contact with the surface of the contact roll. "Constant free fiber length" means that the free fiber length is substantially constant throughout the winding of a package. The "wrap angle" around a roll is the angle between two crossed imaginary lines having the center of the roll as their common point and drawn through the point at which the fiber first makes contact with the surface of the roll and the point at which the fiber loses contact with the surface of the roll, respectively. The "package relaxation" of the elastomeric fiber wound on the supply package can be calculated as the difference between the stretched length the fiber had on the package and its relaxed length off the package, divided by the stretched length.

It has now been unexpectedly found that a stable winding pattern and good package shape, combined with desirably low package relaxation, can be obtained by using a winder in which a puller roll can be positioned close to a traverse means and in particular relationship to a contact roll. The latter, in turn, is positioned so that the fiber passes at least part way around the contact roll before being wound onto a package. The free fiber length between the puller roll and the contact roll can be kept substantially constant (that is, within about ±5%) because it is independent of the size of the wound fiber package and the positions of the two rolls can be fixed in relation to each other and very close together; the traverse pattern is thereby kept constant. Of course, preselected variations can be deliberately made, as described hereinafter.

Accurate transfer of the desired traverse pattern(s) between the traverse guide, the puller roll, the contact roll, and the wound package is improved by the close proximity of the traverse means to the surface of the puller roll (for example, 1.0–3.0 cm, typically about 1.8 cm). Accurate traverse pattern transfer is also improved because the fiber contacts the contact roll before it contacts the package, and the contact roll can be positioned in a fixed relationship, and very close, to the puller roll so that the free fiber length (between the puller and contact rolls) can be made very short and held substantially constant. (Free fiber length can vary slightly, by up to about ±5%, and with each traverse stroke, for example, at the traverse reversals, but not as a result of package growth.) Thus, well-defined reversals are maintained at the ends of the traverse pattern, and the desired helix angles and laydown width are obtained on the package throughout the entire package winding process.

Small wrap angles around the puller and contact rolls are preferred to minimize the size of the winder and the likelihood of undesirable roll wraps, but the fiber must also have sufficient roll contact time and therefore sufficiently large roll wrap angles to come to the roll speed. In the present invention, the wrap angles of the fiber around the puller roll and the contact roll are typically each about 45–210°, preferably about 60–150°, and more preferably about 60–100°. The lower limit of the free fiber length is determined primarily by the diameters of the puller roll and the contact roll and the distance between the rolls. Thus for 2-inch (5.1 cm) diameter puller and contact rolls about 0.05-cm apart, the lower limit of the free fiber length can be about 0.3 inch (0.7 cm). To achieve such low limit, the puller and contact rolls have to counter-rotate. When it is desired that the fiber be allowed to relax to reduce package relaxation, for example, about 5–50%, before being wound up, the free length is long enough to allow the time needed for such relaxation and therefore depends in part on fiber speed. Also, at least some of the relaxation can occur while the fiber is still on the puller roll. Fiber relaxation is fast enough that the free fiber length is not a serious limitation, and operating the puller roll faster than the contact roll usually results in the desired fiber relaxation. The upper limit of the free fiber length can be about 1 inch (2.5 cm), typically about 0.4 inch (1.0 cm).

Any suitable traverse means can be used in the present invention, including for example a cam-driven traverse guide (for example, as disclosed in U.S. Pat. No. 3,675,863) or rotary blades. Preselected winding patterns can be imparted by adjusting the speed, helix angle, and stroke width of the traverse means; once selected, the pattern can be kept constant by the winder and method of the present invention. Optionally, the traverse pattern can be deliberately changed during winding according to preselected variations, for example, to shape the shoulders of the package. Whether the traverse pattern is kept constant or deliberately varied, complex adjustments are not needed with the winder of the present invention to transfer accurately the traverse pattern to the package. This is in contrast to winders of the prior art which must make such adjustments to accommodate the increasing size of the package.

Typically, both the contact roll and the puller roll lack grooves. Either or both rolls can have a matte finish in a central band around the circumference to reduce roll wraps; outside of such central band the circumferential surface can be highly polished to hold the traverse reversals of the fiber while it is on the rolls. The puller roll is a driven roll, while the contact roll can be driven or undriven. The chuck assembly on which a tubecore can be mounted (onto which the fiber is wound) can be driven or undriven, and first and second chuck assemblies can be mounted on a rotatable turret for convenient fiber transfer from a wound package to a new, empty tubecore.

Figure 1A:
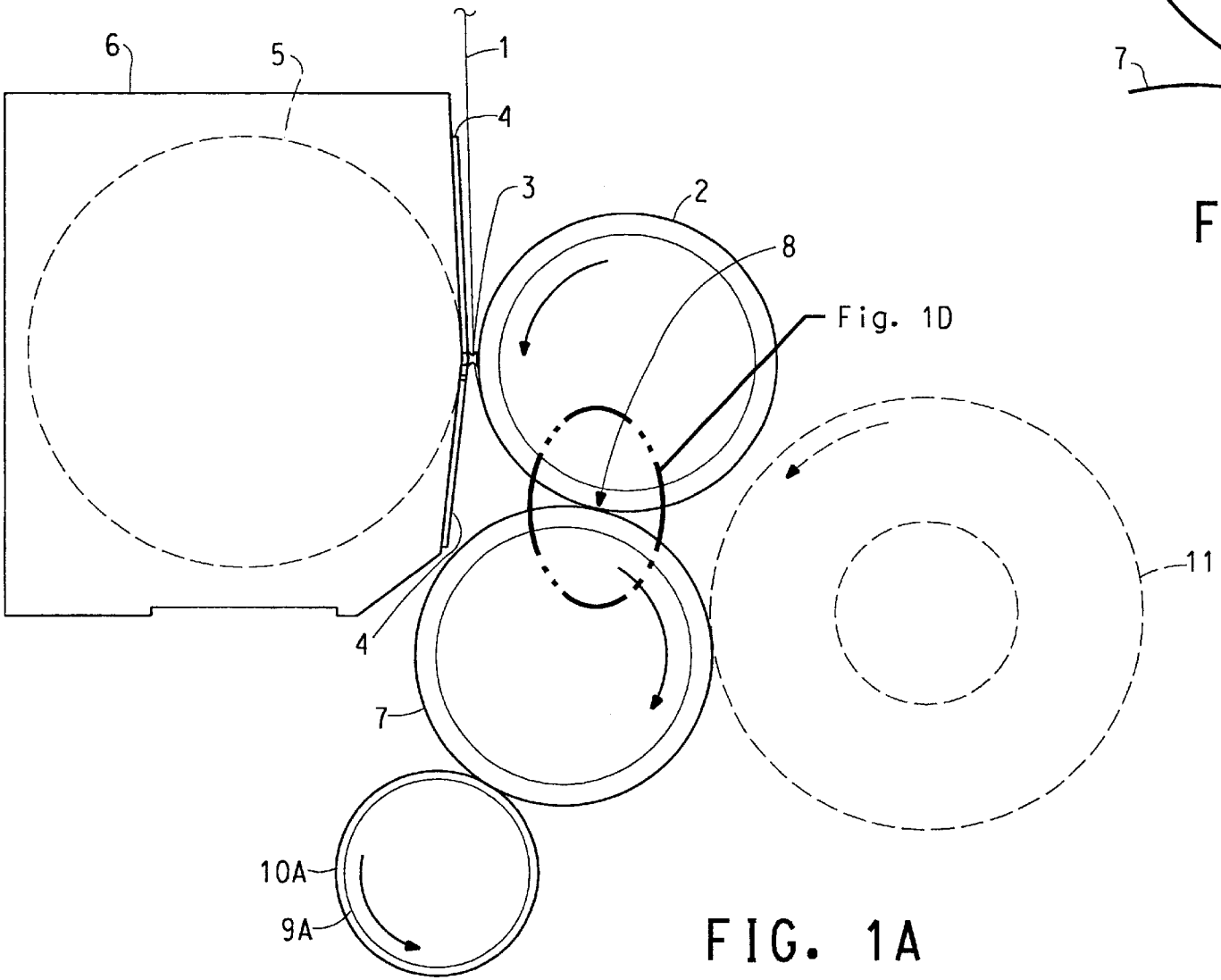
FIGS. 1A, 1B, 1C, 2A, 2B, 2C, 3A, 3B, and 3C schematically illustrate three possible geometries of the winder of the invention.
Figure 1B:
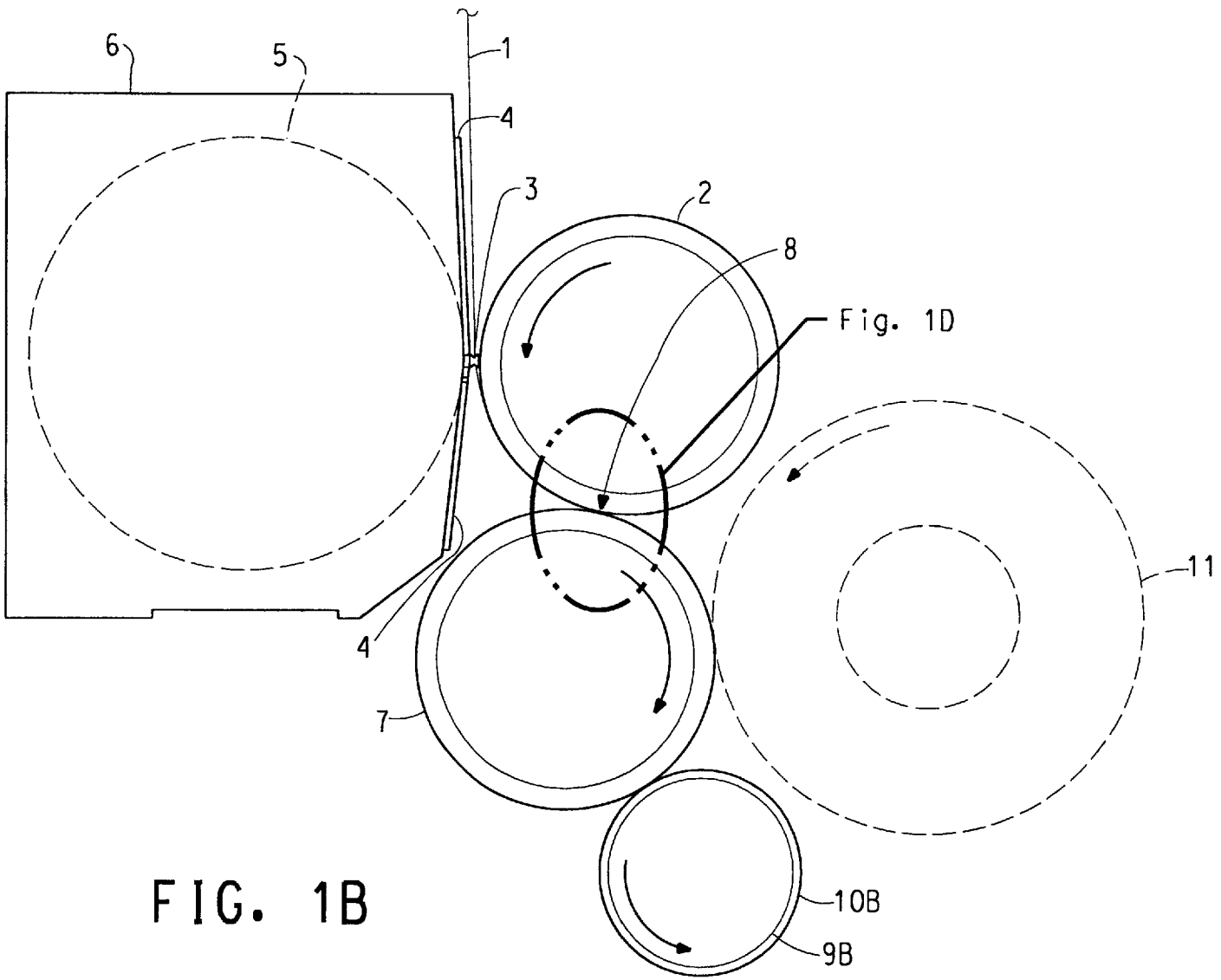
Figure 1C:
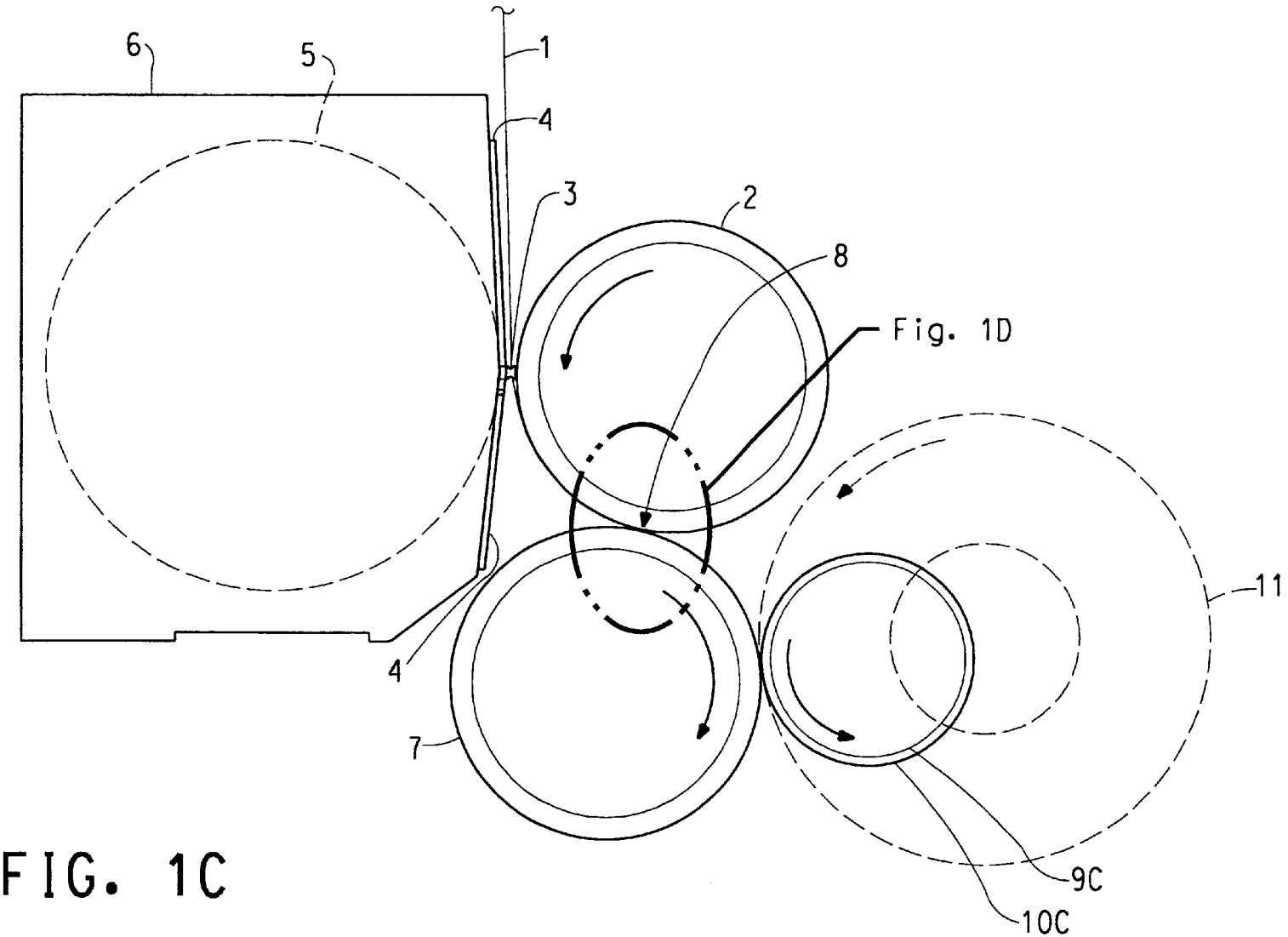
Figure 2A:
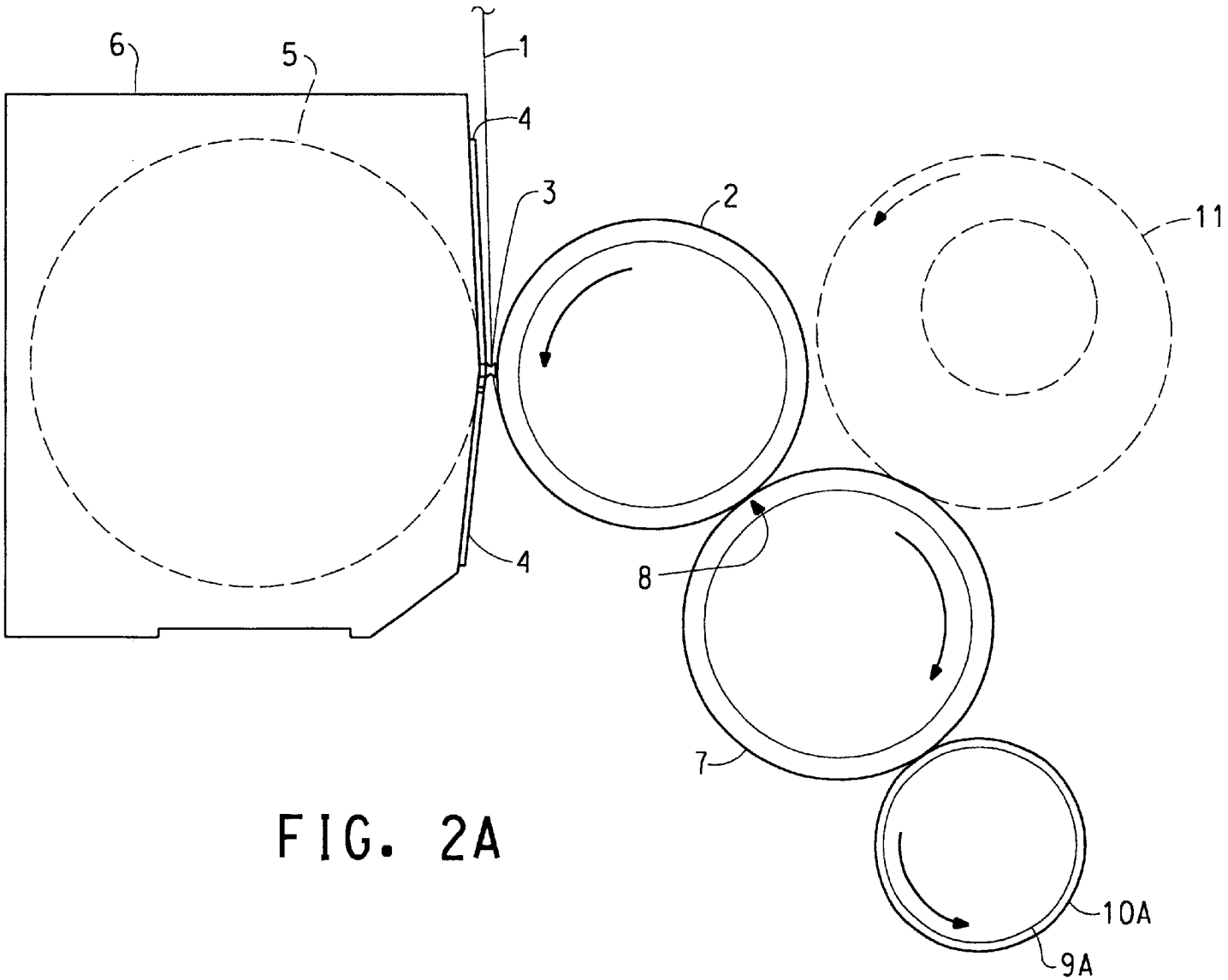
Figure 2B:
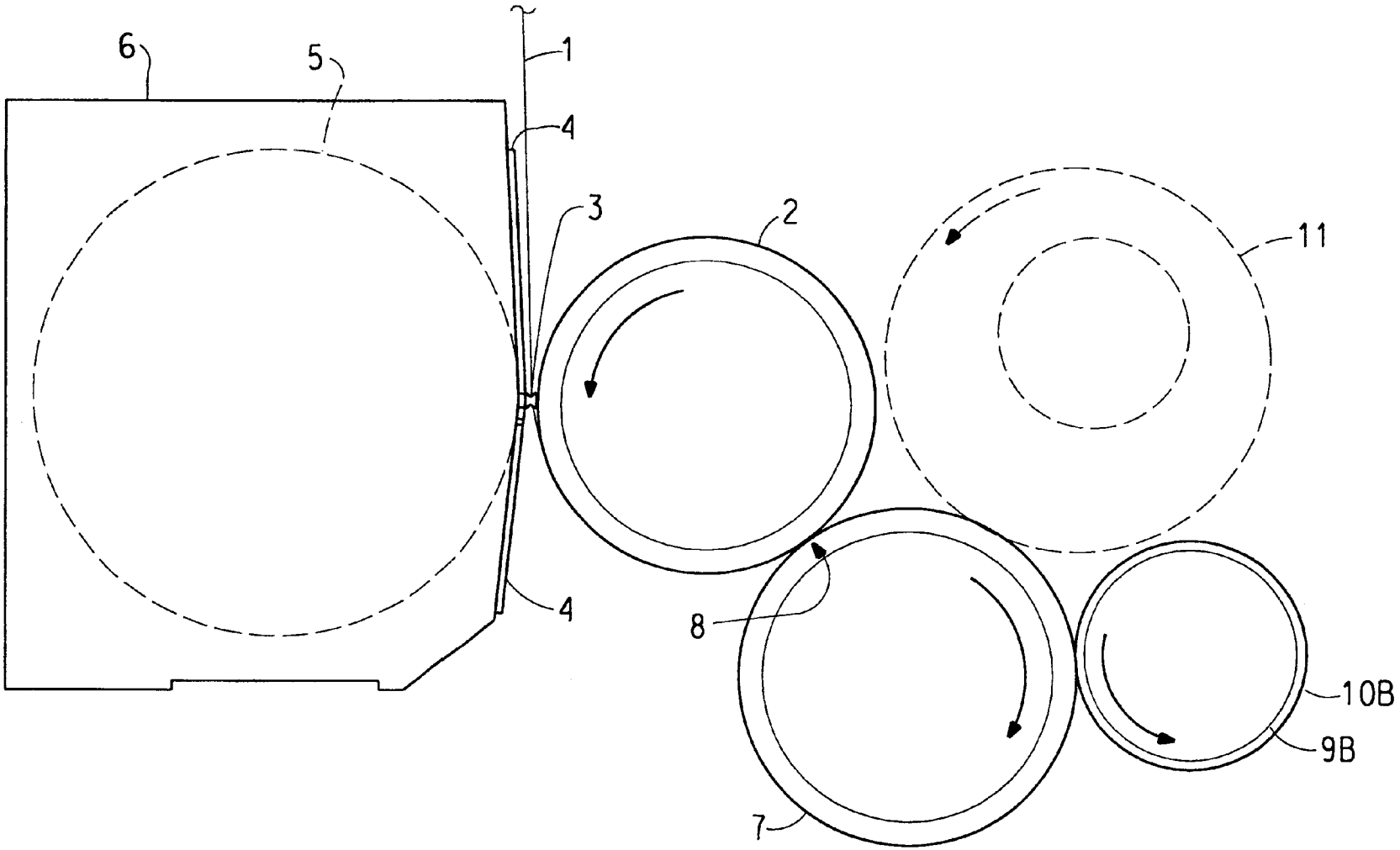
Figure 2C:
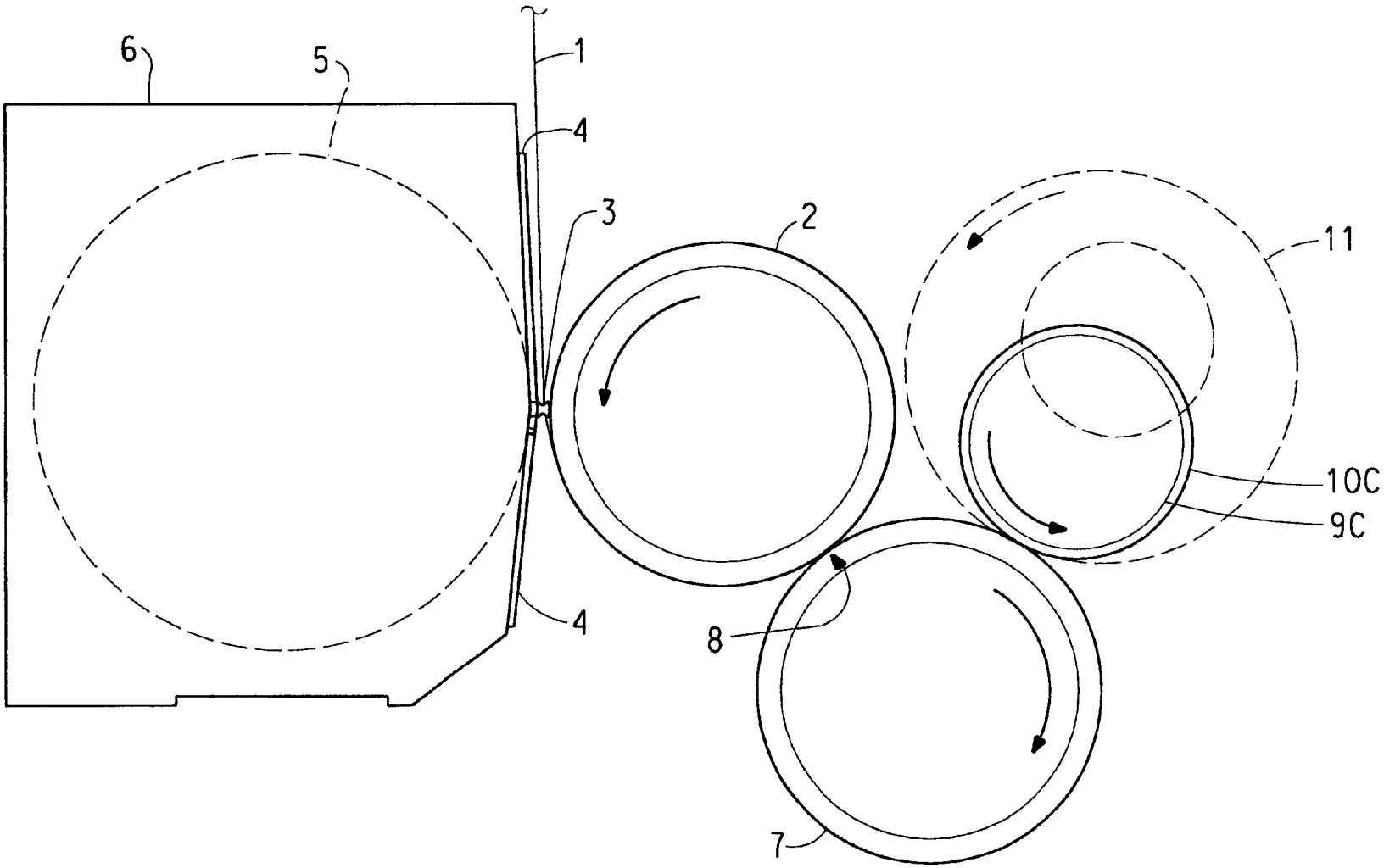
Figure 3A:
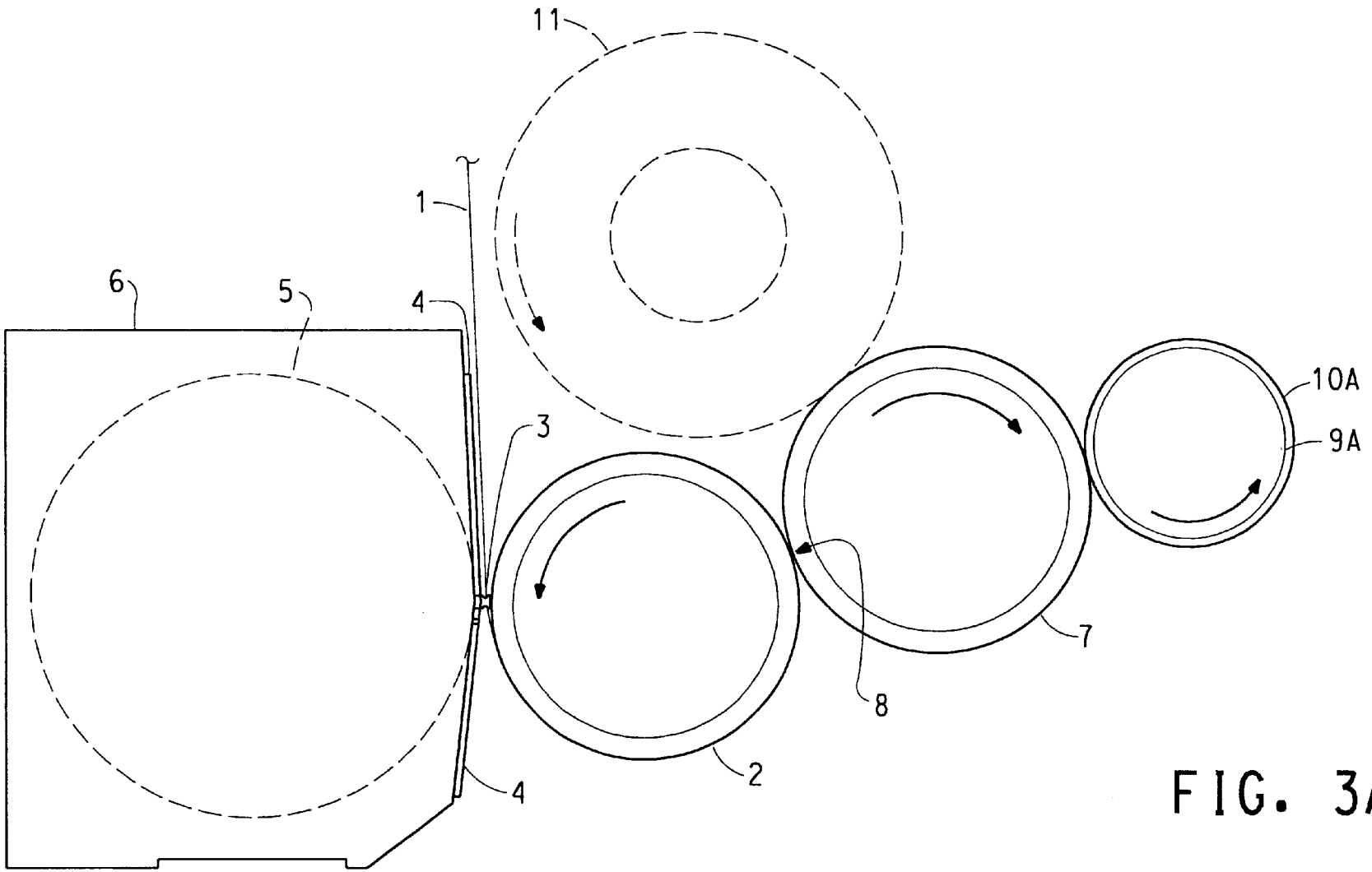
Figure 3B:
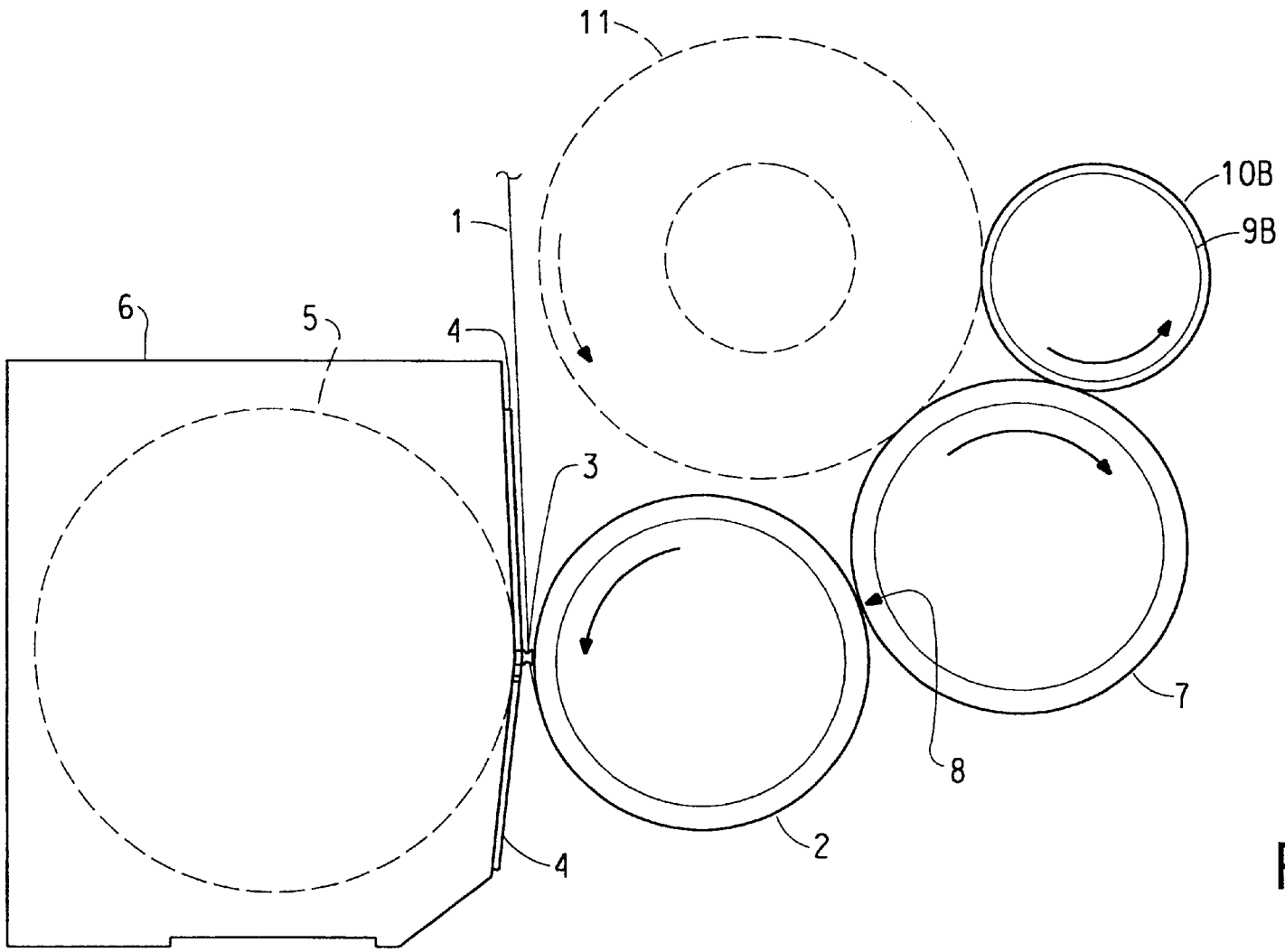
Figure 3C:
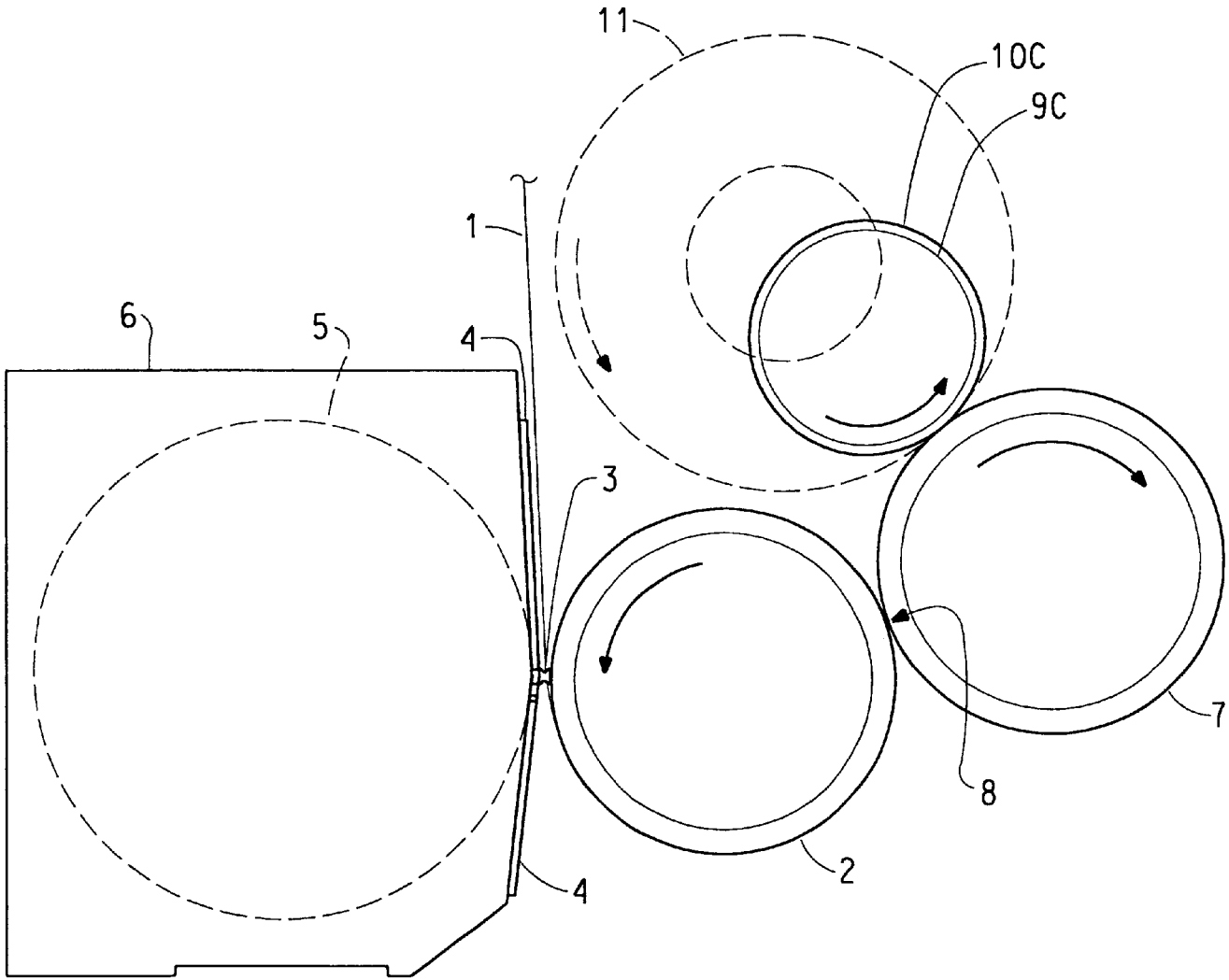

Depending on the winder dimensions desired and space available for using the winder of the invention, various geometries can be used that are within the scope of the invention. Turning first to FIG. 1A, for example, puller roll 2 is mounted adjacent to traverse guide 3, which is mounted between slide plates 4 and driven by a groove in cam 5 mounted in cam box 6. Contact roll 7 is mounted below and adjacent to puller roll 2 so that free fiber length 8 can be less than about 2.5 cm. FIG. 1D expands FIG. 1 in the vicinity of free fiber length 8 for greater clarity. Chuck assembly 9 can be brought adjacent to contact roll 7 so that tubecore 10 is in contact with the contact roll. A rotatable turret (not shown) supports the chuck assembly and optionally a second chuck assembly (also not shown). FIG. 1A shows chuck assembly 9 and tubecore 10 at a first of three possible positions A, B, C, (position "A") each of which is within the scope of the invention. FIGS. 1B and 1C show chuck assembly 9 in the second and third of three examplary positions, respectively. Wound package 11, having the same angular position as empty tubecore 10C, is shown shortly before fiber transfer and doffing. The rolls and package rotate in the directions shown by the arrows. FIGS. 1B and 1C show two alternative geometries of the winder of the invention.

Similarly, FIGS. 2A–C and 3A–C illustrate other angular relationships possible among the components comprising the winder of the invention.

Increasing package size during winding can be accommodated by a vertically or horizontally slidable box supporting the traverse means, puller roll, and contact roll, or by a pendulous swing arm supporting the traverse means and puller and contact rolls, or by turret rotation during winding. When a vertical sliding box is used, the chuck assembly and package being wound can be substantially under the contact roll, for example, as at 9A/10A of FIG. 1A and 9B/10B of FIG. 1B. When a swing arm is used, the chuck and package can be to the side of the contact roll, as shown, for example, at 9C/10C of FIG. 1C, 9A/10A of FIG. 2A and 9B/10B of FIG. 2B, and 9A/10A of FIG. 3A. Other relationships within the scope of the invention can be used depending on the desired geometry.

Figure 4:
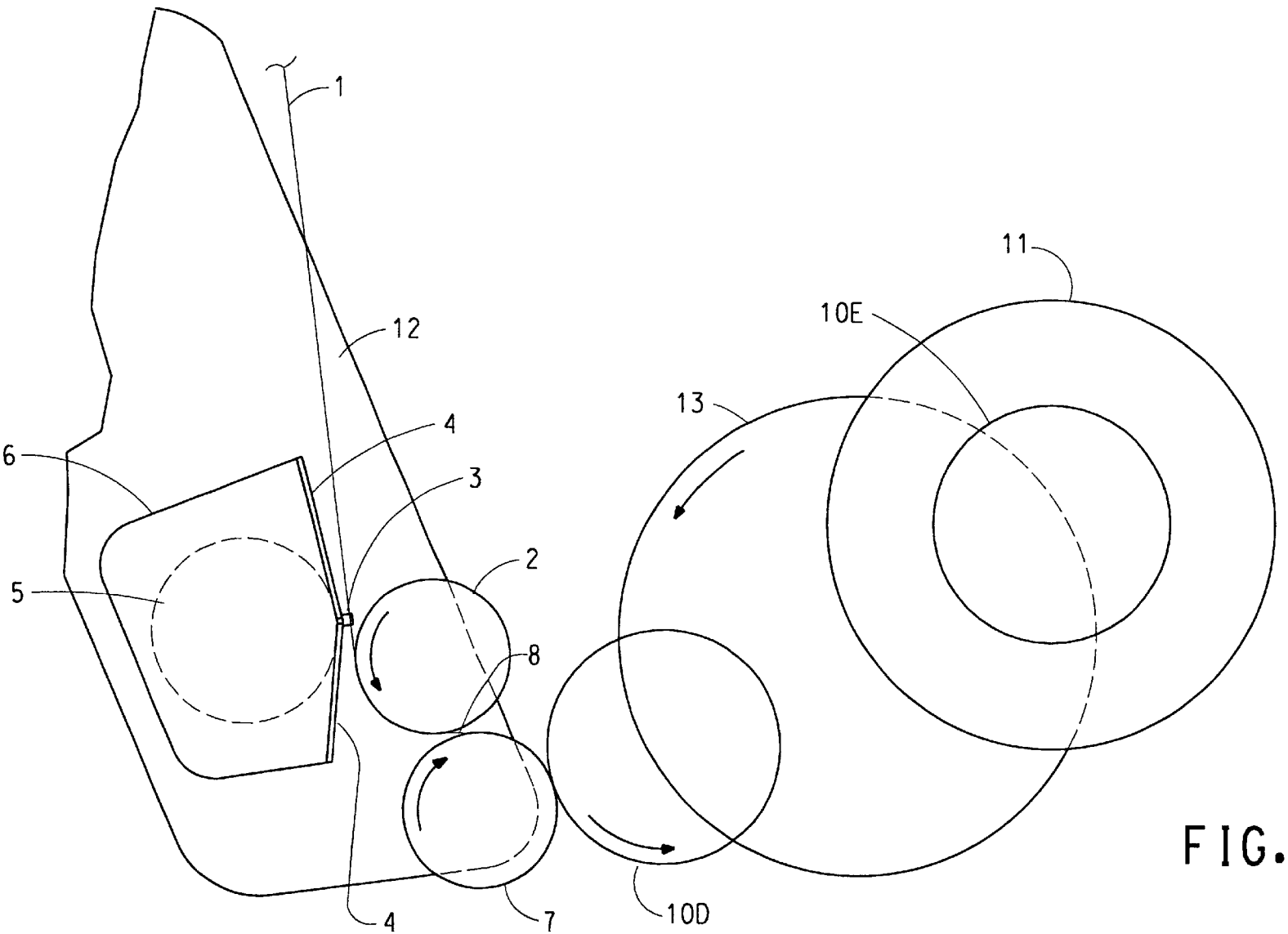
FIG. 4 schematically shows a geometry in which the traverse device, puller roll, and contact roll are mounted on a swing arm.

FIG. 4 shows a particular embodiment of the invention in which puller roll 2, cam box 6 (in which cam 5 is mounted, which in turn with slide plates 4, supports traverse guide 3), and contact roll 7 are mounted on swing arm 12. Rotatable turret 13 supports two chuck assemblies (not shown) on which tubecores 10D and 10E are mounted; wound package 11 is ready for doffing. The rolls, turret, and tubecores rotate in the directions shown by the arrows. Upon counter-clockwise turret rotation, as shown in FIG. 4, the fiber can be transferred from the full package to the new, empty tube with the fiber traveling in the same direction ("co-current") as the surface of the empty tube. If the turret is made to rotate in a direction opposite to that shown in FIG. 4 (clockwise), "counter-current" yarn transfer can be accomplished by snagging the fiber in a slot in the tube or other known snagging means.

Referring again to FIG. 1A, in operation, fiber 1 is spun from a spinning apparatus (not shown), and can be pulled from a feed roll (also not shown) by puller roll 2 through traverse guide 3 which reciprocates the fiber to create the traverse pattern. If desired, the circumferential speed of the puller roll can be at least about 5% higher, typically 5–15% higher, than that of the optional feed roll so that the fiber is under some tension. Such tension is useful to maintain good stability of the threadline so that feed roll wraps are minimized, positional control of the fiber above the traverse guide is acceptable, and the traverse pattern defined by the motion of the traverse guide is maintained as the fiber contacts the puller roll. Fiber 1 passes through a wrap angle around puller roll 2 which can typically be about 45–210°, preferably about 60–150°, and more preferably about 60–100°. Fiber 1 then passes through free fiber length 8 and then through a wrap angle on contact roll 7 which can also typically be about 45–210°, preferably about 60–150°, and more preferably about 60–100°. The free fiber length can be about 0.7–2.5 cm, preferably 0.7–1.0 cm.

The circumferential speed of the puller roll can be about 5–50% higher than that of the contact roll.

If reduced package relaxation is not desired, the puller roll can be operated at a circumferential speed which is the same as, or lower than, that of the contact roll without deleterious effect on the stability of the winding pattern.

Regardless of the relative speeds of the puller and contact rolls, the winder of the invention can be operated without the use of, and need not comprise, feed roll(s). Without such roll(s), the spinning apparatus used to spin the fiber is more compact and less expensive, while the process of the invention retains its advantages. Furthermore, even without such feeder rolls, the winder has the capability of independently adjusting the spinning speed and winding speed, which is typically achieved only with the use of feed roll(s).

Fiber 1 is then wound onto tubecore 10. The process of the invention retains the intended traverse pattern between the traverse guide and the package being wound with minimum deviation.

What is claimed is:

1. A winder for winding at least one elastomeric fiber at the exit of a spinning apparatus comprising:

(A) a traverse means for reciprocating the fiber;

(B) a driven puller roll for receiving the reciprocating fiber from the traverse means;

(C) a contact roll for receiving the fibers from the puller roll, the contact roll having a wrap angle of about 45–210°, wherein there is a substantially constant free fiber length between the puller roll and the contact roll for fiber passage; and (D) at least one chuck assembly for mounting a tubecore in contact with the contact roll.

2. The winder of claim 1 wherein the puller roll has a wrap angle of about 45–210°.

3. The winder of claim 1 wherein the puller roll and the contact roll counter-rotate, the free fiber length is about 0.7–2.5 cm and the puller roll has a wrap angle of about 60–150°.

4. The winder of claim 2 wherein the puller roll and the contact roll counter-rotate, the free fiber length is about 0.7–1.0 cm and the contact roll wrap angle is about 60–150°.

5. The winder of claim 3 wherein the contact roll wrap angle is about 60–100°.

6. The winder of claim 5 wherein the puller roll wrap angle is about 60–100° and the distance of the traverse means from the puller roll is about 1.0–3.0 cm.

7. A process for winding elastomeric fibers comprising the steps of:

(A) spinning an elastomeric fiber and passing the fiber around a feed roll;

(B) passing the fiber around a puller roll and through a substantially constant free fiber length;

(C) passing the fiber around a contact roll through a wrap angle of about 45–210°; and (D) winding up the fiber.

8. The process of claim 7 wherein a wrap angle around the puller roll is about 45–210°, the puller roll and the contact roll counter-rotate, and the free fiber length is about 0.7–2.5 cm.

9. The process of claim 8 wherein the puller roll has a circumferential speed at least about 5% higher than that of the feed roll, the wrap angles of each of the puller roll and contact roll are about 60–150°, and the circumferential speed of the puller roll is about 5–50% higher than that of the contact roll.

10. The process of claim 9 wherein the free fiber length is about 0.7–1.0 cm.

* * * * *